US005650039A

United States Patent [19]

Talieh

[11] Patent Number: 5,650,039

[45] Date of Patent: Jul. 22, 1997

[54] CHEMICAL MECHANICAL POLISHING APPARATUS WITH IMPROVED SLURRY DISTRIBUTION

[75] Inventor: Homayoun Talieh, San Jose, Calif.

[73] Assignee: Applied Materials, Inc., Santa Clara, Calif.

[21] Appl. No.: 205,278

[22] Filed: Mar. 2, 1994

[51] Int. Cl.[6] ..... B41C 1/00

[52] U.S. Cl. ..... 156/636.1; 216/89

[58] Field of Search ..... 156/636.1, 345; 216/89; 437/225, 228, 231, 774; 51/165 R

[56] References Cited

U.S. PATENT DOCUMENTS

| | | | |
|---|---|---|---|
| Re. 34,425 | 11/1993 | Schultz | 51/165.74 |
| 3,137,977 | 6/1964 | Graves | 51/119 |
| 3,156,073 | 11/1964 | Strasbaugh | 51/57 |
| 3,170,273 | 2/1965 | Walsh | 51/281 |
| 3,342,652 | 9/1967 | Reisman et al. | 156/17 |
| 3,559,346 | 2/1971 | Paola | 51/57 |
| 3,748,790 | 7/1973 | Pizzarello et al. | 51/58 |
| 3,841,031 | 10/1974 | Walsh | 51/283 |
| 3,906,678 | 9/1975 | Roth | 51/154 |
| 3,962,832 | 6/1976 | Strasbaugh | 51/217 |
| 3,978,622 | 9/1976 | Mazur et al. | 51/119 |
| 3,986,433 | 10/1976 | Walsh et al. | 90/15 A |
| 4,021,279 | 5/1977 | Hirs | 156/654 |
| 4,143,490 | 3/1979 | Wood | 51/58 |
| 4,239,567 | 12/1980 | Winnings | 156/154 |
| 4,256,535 | 3/1981 | Banks | 156/645 |
| 4,257,194 | 3/1981 | Cailloux | 51/57 |
| 4,358,295 | 11/1982 | Namba et al. | 51/309 |
| 4,373,991 | 2/1983 | Banks | 156/645 |
| 4,380,412 | 4/1983 | Walsh | 409/314 |
| 4,525,954 | 7/1985 | Larsen | 51/58 |
| 4,557,785 | 12/1985 | Ohkuma | 156/345 |
| 4,653,231 | 3/1987 | Cronkhite et al. | 51/5 R |
| 4,680,893 | 7/1987 | Cronkhite et al. | 51/5 R |
| 4,839,993 | 6/1989 | Masuko et al. | 51/129 |
| 4,918,870 | 4/1990 | Tobert et al. | 51/131.3 |
| 4,940,507 | 7/1990 | Harbarger | 156/636 |
| 4,944,836 | 7/1990 | Beyer et al. | 156/645 |
| 4,956,313 | 9/1990 | Cote et al. | 437/203 |
| 4,992,135 | 2/1991 | Doan | 156/636 |
| 5,020,283 | 6/1991 | Tuttle | 31/209 DL |
| 5,036,015 | 7/1991 | Sandhu et al. | 437/8 |
| 5,064,683 | 11/1991 | Poon et al. | 427/39 |
| 5,069,002 | 12/1991 | Sandhu et al. | 51/165 R |
| 5,081,051 | 1/1992 | Mattingly | 437/10 |
| 5,081,796 | 1/1992 | Schultz | 51/165.74 |
| 5,114,875 | 5/1992 | Baker et al. | 437/62 |
| 5,169,491 | 12/1992 | Doan | 156/636 |
| 5,205,082 | 4/1993 | Shendon et al. | 51/283 R |
| 5,209,816 | 5/1993 | Yu et al. | 156/636 |
| 5,216,843 | 6/1993 | Breivogel et al. | 51/131.1 |
| 5,222,329 | 6/1993 | Yu | 51/165.77 |
| 5,225,034 | 7/1993 | Yu et al. | 156/636 |
| 5,232,875 | 8/1993 | Tuttle et al. | 437/225 |
| 5,234,867 | 8/1993 | Schultz et al. | 437/225 |
| 5,244,534 | 9/1993 | Yu et al. | 156/636 |
| 5,297,364 | 3/1994 | Tuttle | 51/209 R |
| 5,302,233 | 4/1994 | Kim et al. | 156/636 |

FOREIGN PATENT DOCUMENTS

| | | | |
|---|---|---|---|
| 0121707 | 10/1984 | European Pat. Off. . | |
| 0593057 | 4/1994 | European Pat. Off. . | |
| 69-34956 | 10/1969 | France . | |
| 3411120 | 11/1984 | Germany . | |
| 4302067 | 1/1993 | Germany . | |
| 810159813 | 10/1981 | Japan | B24B 37/04 |
| 870071024 | 3/1987 | Japan | B24B 37/04 |

OTHER PUBLICATIONS

Pp. 20 to 24 of EBARA CMP System Brochure.

*Primary Examiner*—John Niebling
*Assistant Examiner*—Joni Y. Chang
*Attorney, Agent, or Firm*—Fish & Richardson, P.C.

[57] ABSTRACT

A chemical mechanical polishing apparatus polishes substrates on a rotating polishing pad in the presence of a chemically active and/or physically abrasive slurry. At least one groove is provided in the surface of the polishing pad to allow slurry to reach the surface of the substrate, which is engaged with the polishing pad. The groove extends at least partially in a radial direction. Additionally, a pad conditioning apparatus may be placed onto the rotating polishing pad as substrates are being polished to continuously condition the polishing pad.

4 Claims, 5 Drawing Sheets

CHEMICAL MECHANICAL POLISHING APPARATUS WITH IMPROVED SLURRY DISTRIBUTION

BACKGROUND OF THE INVENTION

1. Field of the Invention

The present invention relates to the field of chemical mechanical polishing. More particularly, the present invention relates to methods and apparatus for chemically mechanically polishing substrates, such as semiconductor substrates, on a rotating polishing pad in the presence of a chemically active and/or physically abrasive slurry, and providing a fresh supply of slurry onto the face of the substrate engaged on the polishing pad as the substrate is being polished. Additionally, the invention may include a pad conditioning apparatus to condition the polishing pad while the pad is being used to polish substrates.

2. Background of the Art

Chemical mechanical polishing is a method of polishing materials, such as semiconductor substrates, to a high degree of planarity and uniformity. The process is used to planarize semiconductor slices prior to the fabrication of microelectronic circuitry thereon, and is also used to remove high elevation features created during the fabrication of the microelectronic circuitry on the substrate. One typical chemical mechanical polishing process uses a large polishing pad, located on a rotating platen, against which a substrate is positioned for polishing, and a positioning member which biases and positions the substrate on the rotating polishing pad. A chemical slurry, which may also include abrasive materials therein, is maintained on the polishing pad to modify the polishing characteristics of the polishing pad to enhance the polishing of the substrate.

The use of chemical mechanical polishing to planarize semiconductor substrates has not met with universal acceptance, particularly where the process is used to remove high elevation features created during the fabrication of microelectronic circuitry on the substrate. One primary problem which has limited the use of chemical mechanical polishing in the semiconductor industry is the limited ability to predict, much less control, the rate and uniformity at which the process will remove material from the substrate. As a result, chemical mechanical polishing is a labor intensive process, because the thickness and uniformity of the substrate must be constantly monitored to prevent over-polishing or inconsistent polishing of the substrate surface.

One factor which contributes to the unpredictability and non-uniformity of the polishing rate of the chemical mechanical polishing process is the non-homogeneous replenishment of slurry at the interface of the substrate and the polishing pad. The slurry is primarily used to enhance the material removal rate of selected materials from the substrate surface. As a fixed volume of slurry in contact with the substrate reacts with the selected materials on the substrate surface, the fixed volume of slurry becomes less reactive and the polishing enhancing characteristics of that fixed volume of slurry are significantly reduced. One approach to overcoming this problem is to continuously provide fresh slurry onto the polishing pad. This approach presents at least two difficulties. Because of the physical configuration of the polishing apparatus, introducing fresh slurry into the area of contact between the substrate and polishing pad is difficult, and providing a consistently fresh supply of slurry to all portions of the substrate is even more difficult. As a result, the uniformity and overall rate of polishing are significantly affected as the slurry reacts with the substrate.

Several methods have been proposed for maintaining fresh slurry at the substrate-polishing pad interface. One method allows the substrate to "float" on the polishing pad. The object of floating the substrate on the polishing pad is to provide a very small downwardly directed force at the substrate-polishing pad interface, so that slurry will flow between the substrate and the polishing pad. This method is ineffective because the slurry is still substantially prevented from moving under the substrate by surface tension and other factors, and the use of a low force at the substrate-polishing pad interface substantially increases the cycle time necessary to polish a substrate.

Another method of providing slurry to the face of the substrate engaged against the polishing pad uses a plurality of holes in the platen, and the slurry is injected through the holes and underside of the polishing pad. The object of this method is to ensure that the slurry is constantly replenished at the substrate-polishing pad interface through the underside of the polishing pad. Although this method does provide slurry to the face of the substrate engaged against the polishing pad, it has several drawbacks. The primary problem encountered when using this method is that the slurry is injected over the entire area of the polishing pad. Therefore, substantial areas of slurry wetted polishing pad are exposed to the ambient environment, and the slurry that is exposed to the environment tends to dry and glaze the surface of the polishing pad. This glazing significantly reduces the ability of the pad to polish the substrate, and therefore reduces the effectiveness of the polishing equipment.

A further method of providing slurry to the substrate-polishing pad is shown in U.S. Pat. No. 5,216,843. In this reference, a plurality of concentric, circular grooves, which have a center that is co-terminus with the axis of rotation of the polishing pad, are provided in the upper surface of the polishing pad. Additionally, radial "microgrooves" are continuously formed in the surface of the polishing pad by a pad conditioning apparatus. The microgrooves serve to condition the polishing pad surface. Both the polishing pad and the substrate rotate as the substrate is processed. Because the substrate rotates, all areas on the surface of the substrate will pass over one, or more, of the grooves during each substrate rotation. However, despite the fact that all areas of the substrate will pass over one or more grooves, the slurry is still non-uniformly replenished on the substrate. In particular, where the substrate is rotated on the rotating polishing pad, zones of high and low slurry replenishment will occur on the face of the substrate because different areas on the substrate will pass over different numbers of grooves as the substrate rotates. If the substrate is not rotated, but is instead reciprocated in a linear or arcuate path, the relative distribution of fresh slurry will vary as the distance on the substrate from a groove increases from the nominal position of the substrate on the polishing pad. Therefore, the frequency at which fresh slurry reaches each location on the substrate varies across the face of the substrate, which leads to zones of high and low material removal on the substrate. In particular, where the substrate is linearly or arcuately reciprocated over a distance less than one-half of the spacing between the concentric grooves, portions of the substrate will not come into contact with any groove area, and thus discrete areas of very low slurry replenishment will occur on the substrate.

In addition to the affect of slurry distribution on the rate and uniformity of polishing, the polishing characteristics of the polishing pad also are affected by glazing and compression of the polishing pad surface. This glazing and compression are natural by-products of the polishing process and typically cause open cells on the polishing pad surface to close by (i) compression or (ii) filling with polished substrate particulates and dried slurry. Once the polishing rate of the particular pad-slurry combination is sufficiently affected by these factors, the polishing pad is either replaced or conditioned with a conditioning wheel, conditioning arm, or other apparatus. During this conditioning step, the substrate is removed from the polishing pad, so no polishing occurs. This reduces the throughput of substrates through the chemical mechanical polishing apparatus, leading to higher processing costs.

One method of conditioning the polishing pad while simultaneously polishing substrates is shown in U.S. Pat. No. 5,216,843. In that reference, a "stylus" type of conditioner is provided to constantly cut "microgrooves" in the polishing pad surface. The stylus sweeps radially inwardly and outwardly as the polishing pad rotates under the stylus head, and thus a zig-zag path of freshly opened cells is cut into the polishing pad. This system has several disadvantages. First, the stylus is delicate and subject to breakdown. Second, the cutting action of the stylus is difficult to control. Finally, the path cut by the stylus is very small and is therefore of limited practical utility in conditioning the polishing pad.

Thus, there exists a need to provide a chemical mechanical polishing apparatus with better slurry distribution and improved pad conditioning.

SUMMARY OF THE INVENTION

The present invention is a chemical mechanical polishing apparatus in which slurry is continuously replenished to the face of the substrate engaged against the polishing pad while simultaneously polishing a substrate on the polishing pad. In the preferred embodiment, the polishing pad of the chemical mechanical polishing apparatus ! s rotated under the substrate, and at least one groove is provided in the polishing pad and extends therein at least partially in a radial direction. The groove provides fresh slurry under the substrate as the groove passes under the substrate, irrespective of the relative motion of the substrate on the polishing pad. The groove preferably begins adjacent the center of the pad and radiates outwardly therefrom to the substrate edge and may be curved to form a spiral groove. Alternatively, one or more circular grooves, having their center offset from the axis of rotation of the polishing pad, may be provided to distribute the slurry to the face of the substrate engaged against the polishing pad. In each embodiment, the groove sweeps under the substrate and deposits fresh slurry on the face of the substrate engaged on the polishing pad. In an additional embodiment, the polishing apparatus includes a pad conditioning member, which provides constant conditioning of the pad to continuously maintain a fresh polishing pad surface on the polishing pad.

BRIEF DESCRIPTION OF THE DRAWINGS

These and other objects and advantages of the information will be apparent from the following description when read in conjunction with the accompanying drawings, wherein.

DESCRIPTION OF THE EMBODIMENTS

Figure 1:
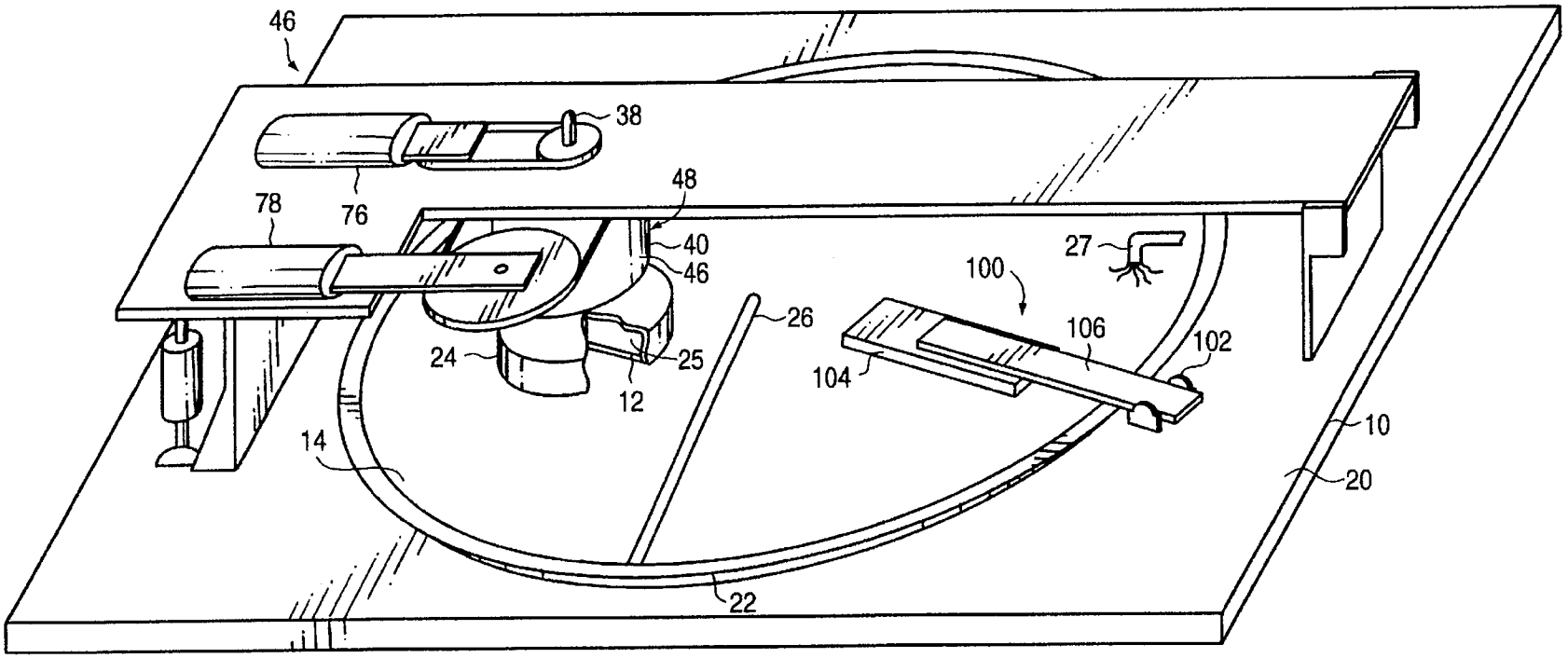
FIG. 1 is a perspective view, partially in section, of an embodiment of the chemical mechanical polishing apparatus of the present invention.

The present invention is chemical mechanical polishing in which slurry is continuously replenished to the face. As shown in FIG. 1, the polishing apparatus 10 generally includes a base 20 which supports a rotary platen 22 thereon, a polishing pad 14 received on the platen 22, a carrier 24 which positions and selectively loads the substrate 12 against the polishing pad 14, and a drive assembly 46 which drives the carrier 24 to move the substrate on the polishing pad 14. The carrier 24 includes a recess, which includes a mounting pad 25 against which the substrate 12 is maintained during polishing. The polishing pad 14 is preferably sized up to a 30 cm radius and includes one or more grooves 26 therein to provide fresh slurry to the face of the substrate 12 engaged against the polishing pad 14. The slurry may be provided to the polishing pad 14 through a slurry port 27, or through the underside of the polishing pad 14. The groove 26 extends at least partially in a radial direction in the surface of the polishing pad 14 for a distance sufficient to ensure that it extends from the radially innermost to the radially outermost position of the substrate 12 on the pad 14. As shown in FIG. 1, the groove may extend entirely radially, i.e., in a straight line path along a radius extending outwardly from the center of the polishing pad 14. Additionally, the groove may extend in a straight line, but not along a radius extending from the center of the polishing pad 14, and thus will extend both radially, and circumferentially but not arcuately, in the polishing pad 14. The composition of the polishing pad 14 is preferably a woven polyeurethane material, such as IC 1000 or Suba IV, which is available from Rodel of Newark, Penn. The slurry is selected to enhance the polishing characteristics of the polishing pad 14 and may include components to selectively increase the polishing of one or more of the materials disposed on the substrate 12 surface. One slurry composition which provides enhanced selective polishing of materials deposited on the substrate 12 surface is an aqueous solution having 5% NaOH, 5% KOH, and colloidal silica having a size of approximately 200 nm. Those skilled in the art may easily vary the polishing pad 14 material, and the slurry composition, to provide the desired polishing of the substrate 12 surface.

Figure 2:
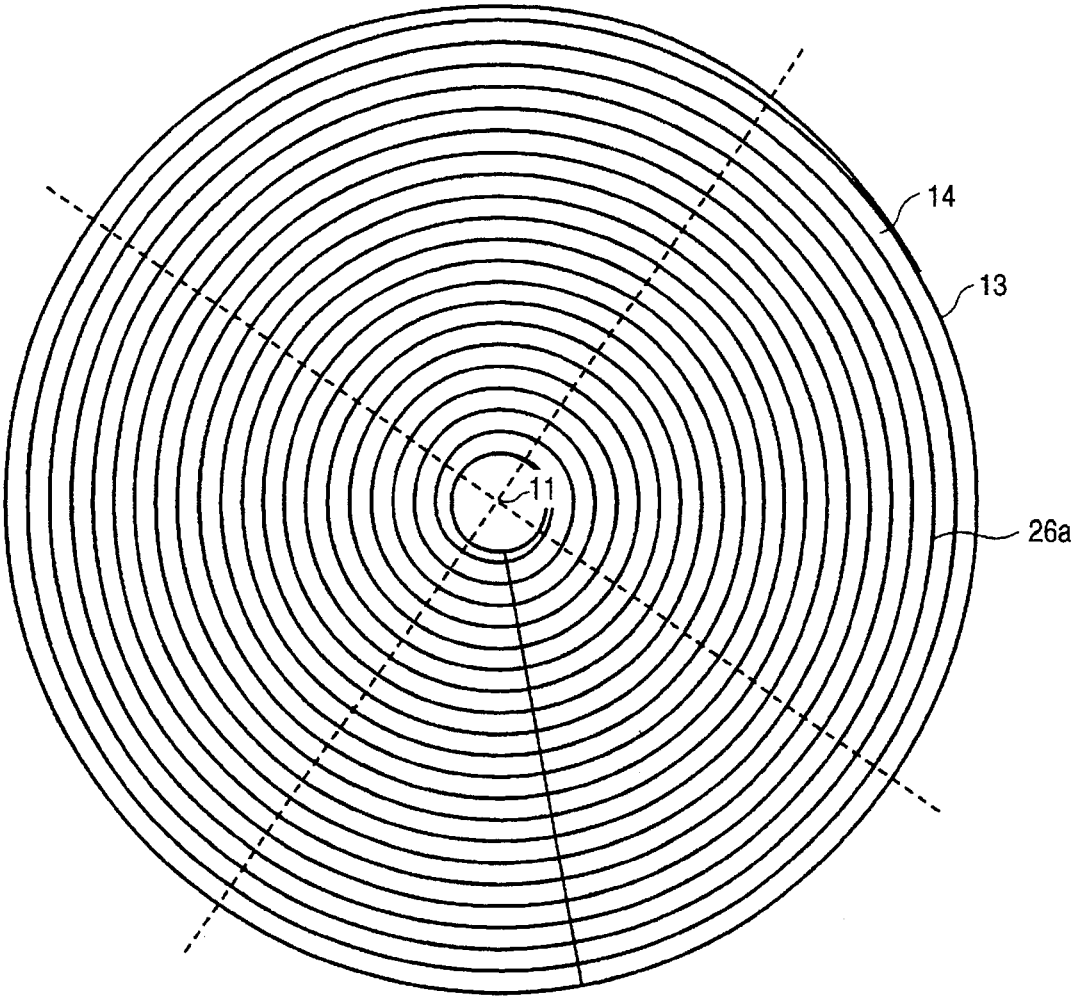
FIG. 2 is a top view of an alternative embodiment of the polishing pad of FIG. 1.
Figure 3:
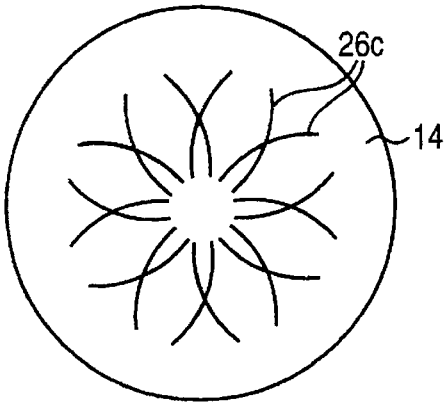
FIG. 3 is a top view of an additional alternative embodiment of the polishing pad of FIG. 1.

Referring now to FIG. 2, an additional preferred embodiment of the polishing pad 14 is shown. The polishing pad 14 includes at least one spiral groove **26*a* therein, which extends outwardly from the axis of rotation 11 of the polishing pad in both a radial and circumferential direction and terminates adjacent the edge 13 of the polishing pad 14. In the preferred embodiment, where the polishing pad has a 30 cm radius, the spiral groove 26*a* forms a spiral pattern on the polishing pad 14 and is approximately 3.2 mm wide, at least 0.5 mm deep, and has a spiral pitch of 12.5 to 25 mm. The spiral groove 26*a* is preferably machined into the polishing pad 14, such as by milling, or it may be stamped into, or otherwise formed in, the pad 14. In FIG. 2, the spiral groove 26*a* is shown extending in a counter-clockwise direction, i.e., tracing the groove 26*a* inward to the center of the polishing pad 14 in a counter-clockwise path. However, the spiral groove 26***a* may extend in a clockwise direction. Further, the direction of the spiral groove 26*a* may be varied with respect to the rotary direction of the polishing pad 14. When the polishing pad 14 rotates in the same direction as the spiral groove 26*a* direction, the spiral groove 26*a* centripetally accelerates the slurry outwardly from the center of the pad and along the underside of the substrate 12. When the direction of the spiral groove 26*a* and the direction of rotation of the polishing pad 14 are in opposite directions, the spiral groove 26*a* scoops slurry under the substrate 12. Although the spiral groove 26*a* is described as having a pitch of approximately 12.5 to 25 mm on a polishing pad 14 having a 30 cm radius, the spiral groove 26*a* is useful at substantially greater and smaller pitches. Additionally, multiple spiral grooves 26*a* having the same direction and pitch may be used. Multiple spiral grooves 26*a* may also be provided in opposite directions to provide a sunburst pattern on the polishing pad 14. Further, spiral or circular arcuate groove segments 26*c*, disposed in a clockwise, counterclockwise, or overlapping clockwise and counterclockwise configuration may be used. One configuration of the overlapping circular arcuate groove segments 26*c* is shown in FIG. 3. The arcuate groove segments 26*c* preferably extend a sufficient radial distance across the face of the polishing pad 14 to ensure that the arcuate groove segments 26*c* can replenish slurry at all areas of the substrate 12 which come into contact with the polishing pad 14.

Figure 4:
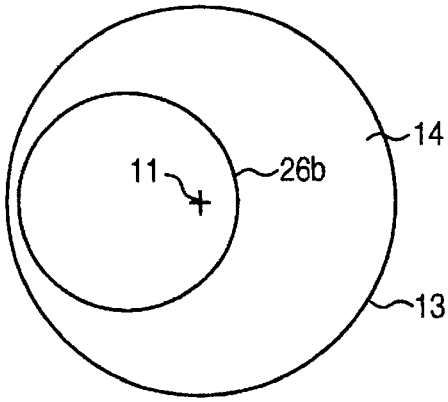
FIG. 4 is a top view of an additional alternative embodiment of the polishing pad of FIG. 1.
Figure 5:
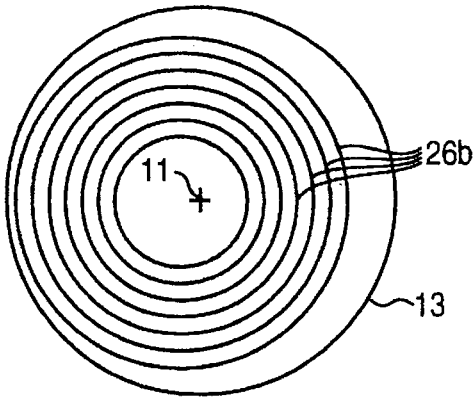
FIG. 5 is a top view of an additional alternative embodiment of the polishing pad of FIG. 1.

Referring now to FIG. 4, a still further embodiment of the invention is shown, wherein the polishing pad 14 includes a circular offset groove 26*b* therein. The circular offset groove 26*b* extends entirely around the polishing pad 14 upper surface, but the center of the circular arc defining the circular offset groove 26*b* is offset from the axis of rotation 11 of the polishing pad 14. Therefore, at any fixed reference point with respect to the apparatus base 20, the circular offset groove 26*b* will appear to move radially inwardly and outwardly as the polishing pad 14 rotates. Although the polishing pad 14 is useful with only one circular offset groove 26*b*, a plurality of concentric circular offset grooves 26*b* as shown in FIG. 5 is preferred. The circular offset grooves 26*b* must be spaced so that the maximum and minimum radial positions of the circular offset grooves 26*b* will extend slightly beyond the positional limits of the substrate 12 on the polishing pad 14, to ensure that slurry is replenished at all areas of the substrate 12 as the polishing pad 14 rotates.

The groove configurations provided herein all provide enhanced slurry distribution under a substrate 12 on a rotating polishing pad 14, and are useful where the substrate 12 is rotated, vibrated, orbited or otherwise moved on the polishing pad 14. Because the grooves in the polishing pad of the present invention extend radially in the polishing pad, slurry maintained on the polishing pad 14 or in any of the grooves configurations will pass under the substrate 12 to continuously provide fresh slurry to all areas of the substrate 12 as it is polished, irrespective of the motion of the substrate 12 on the polishing pad 14. Therefore, the polishing pad 14 configuration of the present invention is particularly suited to applications where the substrate does not rotate, or rotates at a very small speed. Thus, the polishing pad configuration of the present invention enables the use of orbital substrate motion, or reciprocating linear or arcuate substrate motion such as vibration or oscillation while ensuring that the slurry replenishment effect of the groove configurations will not create areas of high and low slurry replenishment on the substrate 12.

Providing linear or arcuate reciprocation of a substrate, such as by vibrating or oscillating the carrier 24, is easily accomplished with linear oscillators or offset cams. However, orbiting a substrate 12 on a rotating polishing pad 14 is a more difficult proposition, particularly where the rotational velocity must be controlled. Referring now to FIG. 1, the general configuration of an orbital drive system 48 with controlled rotation is shown for orbiting a carrier 24, and a substrate 12 received therein. The orbital drive system 48 generally includes a drive motor 76 configured to provide orbital motion to the carrier 24, a control motor 78 configured to provide selective rotary motion to the carrier 24 as it orbits, and a drive assembly 48 coupled to the drive motor 76 and control motor 78, and to the carrier 24, and configured to convert rotational motion of the drive motor 76 and control motor 78 into orbital and controlled rotational motion of the carrier 24. By orbiting the carrier 24, while controlling the rotary motion of the carrier 24, the carrier 24 may be orbited without rotating, or may be orbited with controlled rotation. Preferably, the rotational and orbital motion of the carrier 24, in addition to the rotational motion of the polishing pad 14, provide a relative velocity at the face of the substrate 12 engaged on the polishing pad 14 of 1800 to 4800 cm/min. Additionally, it is preferred that the rotational speed of the polishing pad 14 is no more than 10 rpm, preferably 5 rpm, and that the orbital radius of the substrate 12 is no more than one inch.

Figure 6:
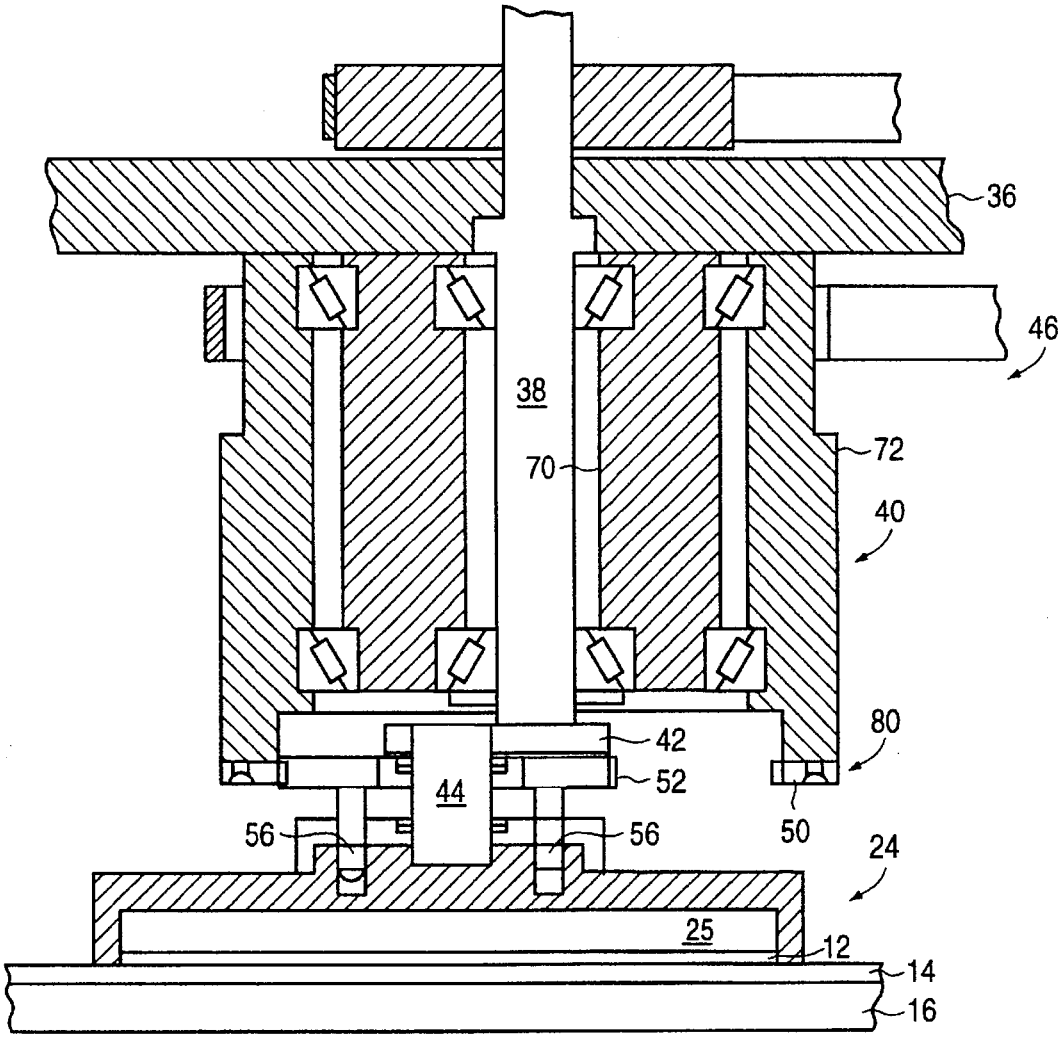
FIG. 6 is a partial sectional view of the chemical mechanical polishing apparatus of FIG. 1.

Referring now to FIG. 6, the preferred configuration of the apparatus for orbiting the substrate 12 on the polishing pad 14 is shown in detail. In this preferred embodiment, the carrier 24 is orbitally driven by a drive assembly 46 suspended from crossbar 36, and rotationally controlled by a compensation assembly 80 formed in the drive assembly 46. The drive assembly 46 includes a rotatable drive shaft 38, and a housing 40 suspended on the crossbar 36 through which the drive shaft 38 extends. The housing 40 includes an inner fixed hub 70 which is connected to the crossbar 36 to rigidly fix the housing 40 to the crossbar 36, and an outer rotatable hub 72 received over the fixed hub 70 on bearings. The outer hub 72 is coupled to the control motor 78 by a drive belt as best shown in FIG. 1. The drive shaft 38 extends through the inner fixed hub 70 and is supported therein on bearings. The upper end of the drive shaft 38 extends above the crossbar 36 and is coupled to the drive motor 76 by a drive belt, as best shown in FIG. 1. The lower end of the drive shaft 38 extends below the housing 40. One end of a cross arm 42 is received on the lower end of the drive shaft 38, and a second shaft 44 is received in the opposite end of the cross arm 42 and extends downwardly therefrom. The lower end of the second shaft 44 engages the carrier 24 to transmit orbital motion into the carrier 24.

When the drive shaft 38 is rotated by the drive motor 76, it sweeps the cross arm 42 in a circular path which in turn moves the second shaft 44 and the carrier 24 attached thereto through an orbital path. The radius of this path is equal to the distance between the center of the drive shaft 38 and the center of the second shaft 44 at the cross arm 42. The lower end of the second shaft 44 is preferably a low friction coupling member, which is received in a mating coupling in the carrier 24 to impart minimal rotation to the carrier 24 or the substrate 12 therein. However, unless the coupling of the second shaft 44 to the carrier 24, as well as the substrate 12 in the carrier 24 to the polishing pad 14, is frictionless, the substrate 12 may move in a rotational direction as it passes through the orbital path.

To control the speed of rotation of the substrate 12, the lower end of the housing 40 is configured as the compensation assembly 80. This compensation assembly 80 includes a ring gear 50 provided about the inner perimeter of the base of the outer hub 72 of the housing 40, and a pinion gear 52 provided on the upper end of the second shaft 44 adjacent the cross arm 42. The pinion gear 52 is meshed with the ring gear 50, and is also coupled via a plurality of free floating pins 56 to the carrier 24. By rotating the outer hub 72 of the housing 40 while simultaneously rotating the drive shaft 38, the effective rotational motion of the pinion gear 52 about the second shaft 44, and of the carrier 24 attached thereto, may be controlled. For example, if the ring gear 50 is rotated at a speed sufficient to cause the pinion gear 52 to make one complete revolution as the carrier 24 makes one orbit, the pinion gear 52, and thus the orbiting carrier 24 attached thereto, will not rotate with respect to a fixed reference point such as the base 10. Additionally, the speed of rotation of the carrier 24 may be matched to, or varied from, the speed of rotation of the polishing pad 14 by simply changing the relative rotational speeds of the drive shaft 38 and the outer rotatable hub 72 of the housing 40.

Figure 7:
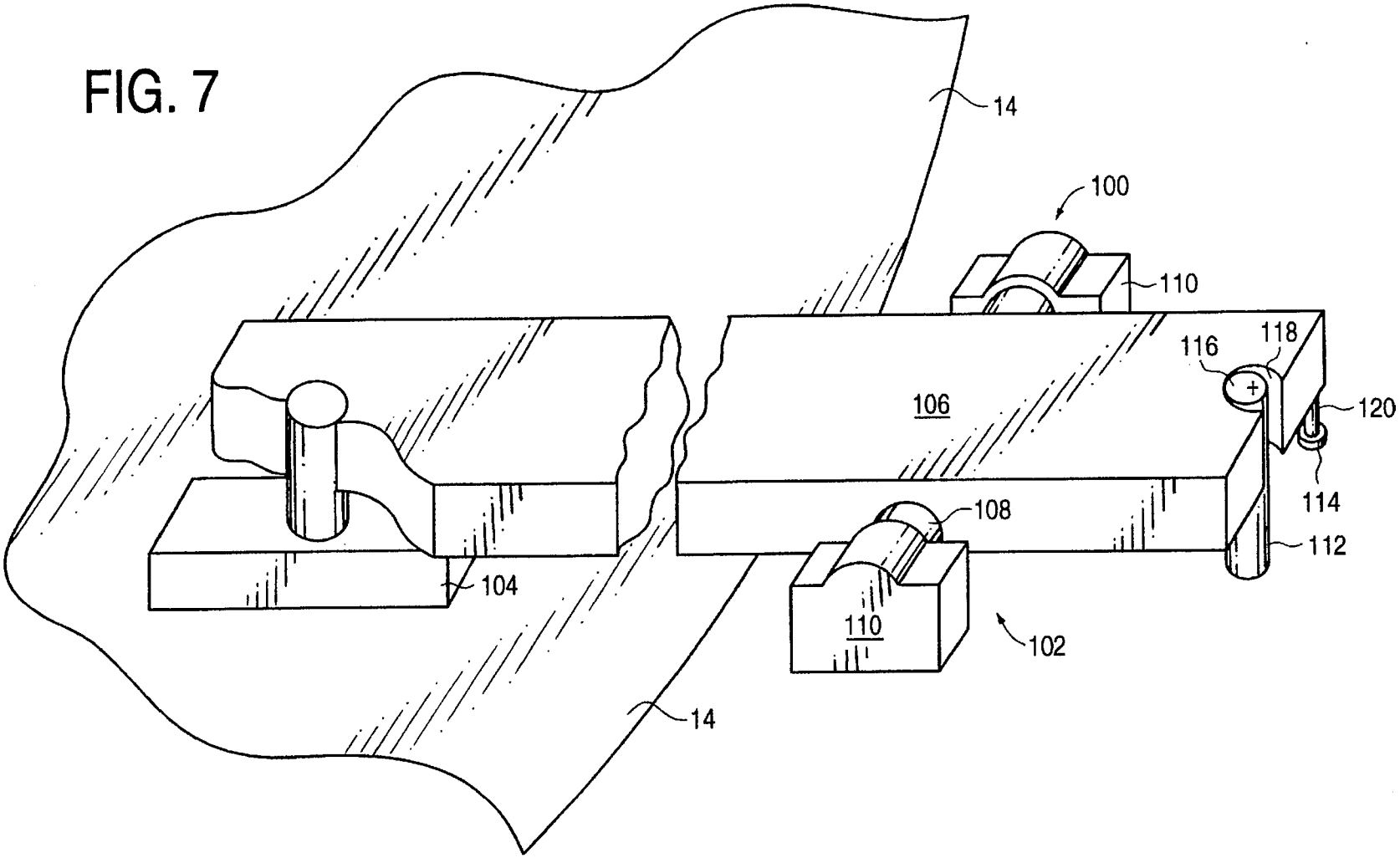
FIG. 7 is an enlarged perspective view of the polishing pad conditioning apparatus shown in FIG. 1.

The use of a polishing pad 14 having grooves which extend at least partially in a radial direction provides constant replenishment of slurry on the substrate 12 surface engaged against the polishing pad 14. However, because the radial position of the substrate 12 on the polishing pad 14 is substantially fixed., an annular region of compressed or filled polishing pad 14 material forms where the substrate 12 engages the polishing pad 14. Referring to FIG. 7, a pad conditioning apparatus 100 is shown for continuously conditioning the polishing pad 14 by abrading the surface thereof during processing of substrates 12 thereon. The pad conditioning apparatus 100 includes a mounting assembly 102, which positions a pad conditioning bar 104 on the polishing pad 14 as the polishing pad 14 rotates. In the preferred embodiment, the mounting assembly 102 includes a generally longitudinal support bar 106, which is supported on a shaft 108. The ends of the shaft 108 are received in a pair of cushioned pillow blocks 110, which are mounted to the apparatus 10 base. The pillow blocks 110 preferably include a metal shell with conformable sleeves therein for receiving the ends of the shaft 108. The sleeves dampen any oscillatory motion of the shaft 108 to increase the life of the pillow block 110.

The pillow block 110 serves as a pivot for the support bar 106. On the base side of the pivot, a vibratory assembly 112 and a loading member 114 are provided in contact with the support bar 106. The vibratory assembly 112 includes an offset rod 116, which extends into a circular aperture 118 in the bar 106. The rod 116 is rotated at a high speed around an axis which is offset from its longitudinal axis. Therefore, a portion of the rod 116 will engage and disengage from the wall of the aperture 118, which will cause the support bar 106 to vibrate. The loading member 114 is preferably a pneumatic piston, mounted in the apparatus base, which includes a piston rod 120 that engages against the underside of the support bar 106 to downwardly bias the opposite end of the support bar 106.

The support bar 106 extends from the pillow blocks 110 over the polishing pad 14 to a radial position located to pass the area of the polishing pad 14 conditioned by the conditioning apparatus 100 under the substrate 12 as it is polished on the polishing pad 14. The conditioning bar 104 is mounted to the end of the support bar 106 and contacts the polishing pad 14. A 600 grit silica, or other abrasive, is provided on the underside of the conditioning bar 104 to engage the upper surface of the polishing pad 14 as the polishing pad rotates thereunder. The conditioning bar 104 is slightly longer that the circumference of the substrate 12 so that the abrasive will condition an annular area larger that the circumference of the substrate 12. Thus, the polishing pad 14 is continuously conditioned as it polishes a substrate 12, which eliminates the need to separately condition the polishing pad 14 after one or more substrates have been polished thereon. Although the conditioning bar 104 is described as using an abrasive silica grit, other materials such as diamond tipped pins, blades or other abrasives may be used to condition the polishing pad 14.

The embodiments of the invention described herein may be used concurrently, or independently, to maximize the uniformity and rate at which substrates are polished.

I claim:

1. A method of polishing a substrate, comprising:

a) providing a polishing pad having at least one circular groove wherein the circular groove encircles an axis of rotation of the polishing pad with a center of the circular groove offset from the axis of rotation of the polishing pad;

b) providing a slurry on the polishing pad;

c) rotating the polishing pad; and d) placing a substrate on the polishing pad and polishing the substrate as the groove replenishes the slurry at the interface of the substrate and the polishing pad.

2. The method of claim 1, wherein the polishing pad has a plurality of concentric circular grooves and wherein a center of the circular grooves is offset from the axis of rotation of the polishing pad.

3. The method of claim 2, wherein the grooves are evenly spaced from each other.

4. The method of claim 2, wherein the grooves are spaced at varying distances from one another.

* * * * *